US005933960A

United States Patent [19]

Avidor

[11] Patent Number: 5,933,960

[45] Date of Patent: Aug. 10, 1999

[54] SHAVING APPARATUS AND METHOD OF SHAVING

[76] Inventor: Joseph Avidor, 20 Hapardes, Ramat Hasharon, Israel

[21] Appl. No.: 08/902,939

[22] Filed: Jul. 30, 1997

Related U.S. Application Data

[63] Continuation-in-part of application No. 08/409,174, Mar. 23, 1995, Pat. No. 5,678,311.

[51] Int. Cl.[6] ..... B26B 19/42; B26B 21/08

[52] U.S. Cl. ..... 30/34.2; 30/50; 30/51

[58] Field of Search ..... 30/34.2, 34.05, 30/77, 81, 82, 83, 50, 51, 41.7, 41

[56] References Cited

U.S. PATENT DOCUMENTS

| | | | |
|---|---|---|---|
| 1,404,603 | 1/1922 | Gray . | |
| 2,101,737 | 12/1937 | Gesler . | |
| 2,559,189 | 7/1951 | Griffin . | |
| 2,711,582 | 6/1955 | Scully . | |
| 2,734,266 | 2/1956 | Schreyer . | |
| 2,837,820 | 6/1958 | Ostrowski . | |
| 2,880,503 | 4/1959 | Carissimi . | |
| 2,952,907 | 9/1960 | Miller . | |
| 3,183,591 | 5/1965 | Dumont . | |
| 3,802,072 | 4/1974 | Wintercorn . | |
| 4,170,821 | 10/1979 | Booth | 30/41 |
| 4,378,633 | 4/1983 | Jacobson . | |
| 5,022,154 | 6/1991 | Johnson . | |
| 5,038,472 | 8/1991 | Iderosa | 30/51 |
| 5,044,077 | 9/1991 | Ferraro et al. | 30/51 |
| 5,134,775 | 8/1992 | Althaus et al. | 30/41 |
| 5,191,712 | 3/1993 | Crook et al. . | |
| 5,251,376 | 10/1993 | Althaus et al. . | |
| 5,347,717 | 9/1994 | Ts'ai | 30/51 |

FOREIGN PATENT DOCUMENTS

| | | |
|---|---|---|
| 1015370 | 9/1952 | France . |
| 6-142351 | 5/1994 | Japan . |
| 460684 | 2/1937 | United Kingdom . |

*Primary Examiner*—M. Rachuba
*Assistant Examiner*—Sean Pryor
*Attorney, Agent, or Firm*—Mark M. Friedman

[57] ABSTRACT

A shaving apparatus to be drawn by a user across an area of skin in a shaving direction for removing hair from the area of skin includes a handle to be held by the user, a cutter device mountable on the handle, and a hair erecting device mounted forwardly of and adjacent to the cutter device. The hair erecting device features a rotary assembly with a plurality of axially extending projections for engaging the hair of the user, and a drive mechanism for driving the rotary assembly. The projections of the rotary assembly engage the hair of the user and erect the hair so as to improve operation of the cutter device. The shaving apparatus may be implemented with the hair erecting device attached to the handle and the cutter device in the form of a replaceable cartridge. A rear roller may be mounted behind the cutter device for dispensing a chemical composition onto the skin of the user.

18 Claims, 9 Drawing Sheets

SHAVING APPARATUS AND METHOD OF SHAVING

This is a Continuation-in-Part of U.S. patent application Ser. No. 08/409,174, filed Mar. 23, 1995 now U.S. Pat. No. 5,678,311.

FIELD AND BACKGROUND OF THE INVENTION

The present invention relates to shaving apparatus and method, and particularly to such apparatus and method wherein a hair erecting device moves the hairs towards an erect position prior to their being cut.

Shaving apparatus of the foregoing type is known particularly in manual shavers including a shaver head and one or more razor blades. one known manual shaver of this type is called the "Gillette Sensor EXCEL". This manual shaver includes a series of soft, flexible, microfins ahead of the razor blades, which fins are said to stretch the skin and to cause the hairs to spring upward so the blade can shave closer. Other constructions have been described in the patent literature for stretching the skin prior to engagement by the cutter device, as shown for example in U.S. Pat. Nos. 1,777,691, 1,1833,079, 2,101,737, 3,138,865, 4,044,463, 4,189,832 and 4,741,103 for manual shavers, and U.S. Pat. No. 2,952,907 for electrical shavers.

SUMMARY OF THE INVENTION

An object of the present invention is to provide shaving apparatus having a novel hair erecting device for moving the hairs towards an erect position prior to their engagement by the blades.

According to the present invention, there is provided shaving apparatus, comprising: a shaver head movable across the user's skin to be shaved of hair, and a cutter device carried by the shaver head and extending transversely to the direction of movement of the shaver head across the user's skin; characterized in that the apparatus further includes a hair erecting device forwardly of and adjacent to the cutter device for moving the hairs towards an erect position prior to their engagement with the cutter device; the hair erecting device comprising a rotary assembly having an outer surface configured to engage the hairs and to move them towards an erect position during the rotation of the rotary assembly.

Preferably, the outer surface of the rotary assembly is formed with protrusions which engage the hairs and move them to an erect position, Such a construction is believed to be more effective in erecting the hairs before their engagement by the cutter device than, for example, the shavers including static microfins which merely stretch the skin to cause the hairs to spring upwardly. Accordingly, shaving apparatus constructed in accordance with the foregoing features is believed capable of providing a closer shave than apparatus including static microfins.

According to further features in the described preferred embodiments the protrusions are in the form of fins extending along the length of the rotary assembly. In the described preferred embodiments, each fin has a first face defining a large angle with the tangent to the surface of the rotary member, and a second face defining a small angle with the tangent to the surface of the rotary member. The rotary member is oriented and rotated such that the first face of the fins first engages the hairs and moves them towards an erect position and the second face of the fins then engages the hairs to maintain them erect before their engagement by the cutter device.

According to further features in some described embodiments, the rotary assembly includes a cylindrical roller, whereas in another described embodiment it includes a closed loop web supported and rotated by a pair of rotary members at its opposite ends. Further embodiments are described wherein the rotary assembly includes a first cylinder rollable along the skin to rotate the cylinder, and a second cylinder carrying the protrusion and coupled to the first cylinder by a step-up transmission which rotates the second cylinder and its protrusions at a larger rotary velocity than that of the first cylinder.

The invention is described below primarily as embodied in a manual shaver wherein the cutter device comprises a razor blade assembly included in the shaver head and carried by a handle graspable by the user for moving the shaver head across the user's skin to be shaved. The hair erecting rotary assembly may be incorporated with the razor blade assembly in a common replaceable cartridge; alternatively, the hair erecting rotary assembly could be incorporated in the handle so that it would not be replaced with the razor blade cartridge.

A further embodiment is described wherein the apparatus is an electrical shaver, and the cutter device includes blades driven by an electrical motor.

According to another aspect of the present invention, there is provided shaving apparatus comprising: a shaver head movable across the user's skin to be shaved of hair; a cutter device carried by the shaver head and extending transversely to the direction of movement of the shaver head across the user's skin; and a pair of rollers on opposite sides of the shaver head mounted for rotation on an axis extending parallel to that of the cutter device, each of the rollers having a skin engaging surface effective to constrain movement of the shaver head to a direction perpendicular to the axis of the rollers, and the axis of the cutter device. Such rollers, which may be part of the hair erecting device, thereby decrease the danger of moving the shaver head such as to cause the cutter device (e.g., one or more razor blades) to cut the user's skin.

According to a still further aspect of the present invention, there is provided a method of shaving hairs from a user's skin by moving a cutter device across the user's skin to engage and cut the hairs, and causing the hairs to move towards an erect position before their engagement by the cutter device; characterized in that the hairs are caused to move towards an erect position by engaging them, just prior to their engagement by the cutter device, with protrusions formed on the outer surface of a rotary assembly rolled along the user's skin forwardly of the cutter device.

Further features and advantages of the invention will be apparent from the description below.

According to the teachings of the present invention there is provided, a shaving apparatus to be drawn by a user across an area of skin in a shaving direction for removing hair from the area of skin, the apparatus comprising: (a) a handle to be held by the user; (b) a cutter device mountable on the handle, the cutter device including at least one blade extending transversely to the shaving direction; and (c) a hair erecting device mounted forwardly of and adjacent to the cutter device, the hair erecting device including: (i) a rotary assembly mounted so as to be rotatable about an axis parallel to the cutter device, the rotary assembly having a plurality of axially extending projections for engaging the hair of the user, and (ii) a drive mechanism for driving the rotary assembly such that the projections engage the hair of the user and erect the hair so as to improve operation of the cutter device.

According to a further feature of the present invention, the hair erecting device is attached to the handle and the cutter device is implemented as a replaceable cartridge, the replaceable cartridge being pivotally mountable about the axis of the rotary assembly, the handle including a support for supporting a part of the replaceable cartridge displaced from the axis.

According to a further feature of the present invention, the support includes a spring element.

According to a further feature of the present invention, the hair erecting device is attached to the handle to form a handle unit, the cutter device being implemented as a replaceable cartridge mountable on the handle unit, wherein the handle unit includes a hinge for permitting tilting of the cutter device relative to the handle.

According to a further feature of the present invention, the hinge is implemented as a flexible section integral to the handle.

According to a further feature of the present invention, the hinge is implemented as a pivotal connection between the handle and the hair erecting device.

According to a further feature of the present invention, there is also provided a rear roller mounted behind the cutter device, the rear roller having a surface configured for dispensing a chemical composition onto the skin of the user.

According to a further feature of the present invention, there is also provided a rear roller mounted behind the cutter device, the rear roller being coupled so as to be driven by the drive mechanism.

According to a further feature of the present invention, there is also provided a rear roller mounted behind the cutter device, the rear roller being coupled so as to provide rotational power to the drive mechanism.

According to a further feature of the present invention, the drive mechanism includes at least one drive wheel configured to engage the surface of the user's skin so as to rotate as the shaving apparatus is drawn across the skin, the drive wheel having an internally toothed track for supplying rotational power to the rotary assembly.

There is also provided according to the teachings of the present invention, a shaving apparatus to be drawn by a user across an area of skin in a shaving direction for removing hair from the area of skin, the apparatus comprising: (a) a handle to be held by the user; (b) a cutter device mountable on the handle, the cutter device including at least one blade extending transversely to the shaving direction; and (c) a hair erecting device mounted forwardly of and adjacent to the cutter device, the hair erecting device including: (i) a rotary assembly mounted so as to be rotatable about an axis parallel to the cutter device, the rotary assembly having a plurality of projections for engaging the hair of the user, and (ii) a drive mechanism for driving the rotary assembly such that the projections engage the hair of the user and erect the hair so as to improve operation of the cutter device, wherein the hair erecting device is attached to the handle and the cutter device is implemented as a replaceable cartridge, the replaceable cartridge being pivotally mountable about the axis of the rotary assembly, the handle including a support for supporting a part of the replaceable cartridge displaced from the axis.

According to a further feature of the present invention, the support includes a spring element.

According to a further feature of the present invention, there is also provided a rear roller mounted behind the cutter device, the rear roller having a surface configured for dispensing a chemical composition onto the skin of the user.

According to a further feature of the present invention, there is also provided a rear roller mounted behind the cutter device, the rear roller being coupled so as to be driven by the drive mechanism.

According to a further feature of the present invention, there is also provided a rear roller mounted behind the cutter device, the rear roller being coupled so as to provide rotational power to the drive mechanism.

According to a further feature of the present invention, the drive mechanism includes at least one drive wheel configured to engage the surface of the user's skin so as to rotate as the shaving apparatus is drawn across the skin, the drive wheel having an internally toothed track for supplying rotational power to the rotary assembly.

There is also provided according the teachings of the present invention, a shaving apparatus to be drawn by a user across an area of skin in a shaving direction for removing hair from the area of skin, the apparatus comprising: (a) a handle to be held by the user; (b) a cutter device mountable on the handle, the cutter device including at least one blade extending transversely to the shaving direction; and (c) a hair erecting device mounted forwardly of and adjacent to the cutter device, the hair erecting device including: (i) a rotary assembly mounted so as to be rotatable about an axis parallel to the cutter device, the rotary assembly having a plurality of projections for engaging the hair of the user, and (ii) a drive mechanism for driving the rotary assembly such that the projections engage the hair of the user and erect the hair so as to improve operation of the cutter device, wherein the hair erecting device is attached to the handle to form a handle unit, the cutter device being implemented as a replaceable cartridge mountable on the handle unit, wherein the handle unit includes a hinge for permitting tilting of the cutter device relative to the handle.

According to a further feature of the present invention, the hinge is implemented as a flexible section integral to the handle.

According to a further feature of the present invention, the hinge is implemented as a pivotal connection between the handle and the hair erecting device.

According to a further feature of the present invention, there is also provided a rear roller mounted behind the cutter device, the rear roller having a surface configured for dispensing a chemical composition onto the skin of the user.

According to a further feature of the present invention, the drive mechanism includes at least one drive wheel configured to engage the surface of the user's skin so as to rotate as the shaving apparatus is drawn across the skin, the drive wheel having an internally toothed track for supplying rotational power to the rotary assembly.

There is also provided according to the teachings of the present invention, a shaving apparatus to be drawn by a user across an area of skin in a shaving direction for removing hair from the area of skin, the apparatus comprising: (a) a handle to be held by the user; (b) a cutter device mountable on the handle, the cutter device including at least one blade extending transversely to the shaving direction; (c) a hair erecting device mounted forwardly of and adjacent to the cutter device, the hair erecting device including: (i) a rotary assembly mounted so as to be rotatable about an axis parallel to the cutter device, the rotary assembly having a plurality of projections for engaging the hair of the user, and (ii) a drive mechanism for driving the rotary assembly such that the projections engage the hair of the user and erect the hair so as to improve operation of the cutter device; and (d) a rear roller mounted behind the cutter device, the rear roller having a surface configured for dispensing a chemical composition onto the skin of the user.

According to a further feature of the present invention, the hair erecting device is attached to the handle and the cutter device is implemented as a replaceable cartridge, the replaceable cartridge being pivotally mountable about the axis of the rotary assembly, the handle including a support for supporting a part of the replaceable cartridge displaced from the axis.

According to a further feature of the present invention, the support includes a spring element.

According to a further feature of the present invention, the hair erecting device is attached to the handle to form a handle unit, the cutter device being implemented as a replaceable cartridge mountable on the handle unit, wherein the handle unit includes a hinge for permitting tilting of the cutter device relative to the handle.

According to a further feature of the present invention, the hinge is implemented as a flexible section integral to the handle.

According to a further feature of the present invention, the hinge is implemented as a pivotal connection between the handle and the hair erecting device.

According to a further feature of the present invention, the drive mechanism includes at least one drive wheel configured to engage the surface of the user's skin so as to rotate as the shaving apparatus is drawn across the skin, the drive wheel having an internally toothed track for supplying rotational power to the rotary assembly.

There is also provided according to the teachings of the present invention, a shaving apparatus to be drawn by a user across an area of skin in a shaving direction for removing hair from the area of skin, the apparatus comprising: (a) a handle to be held by the user; (b) a cutter device mountable on the handle, the cutter device including at least one blade extending transversely to the shaving direction; and (c) a hair erecting device mounted forwardly of and adjacent to the cutter device, the hair erecting device including: (i) a rotary assembly mounted so as to be rotatable about an axis parallel to the cutter device, the rotary assembly having a plurality of projections for engaging the hair of the user, and (ii) a drive mechanism including at least one drive wheel configured to engage the surface of the user's skin so as to rotate as the shaving apparatus is drawn across the skin, the drive wheel having an internally toothed track for supplying rotational power to drive the rotary assembly such that the projections engage the hair of the user and erect the hair so as to improve operation of the cutter device.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a shaving apparatus and method of shaving.

The principles and operation of shaving apparatus and methods according to the present invention may be better understood with reference to the drawings and the accompanying description.

Figure 1:
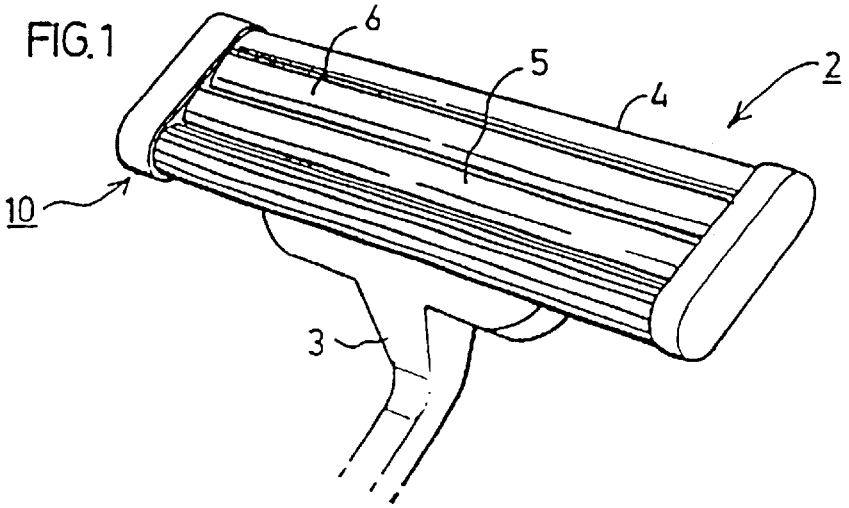
FIG. 1 illustrates one form of manual shaver constructed in accordance with the present invention.
Figure 2:
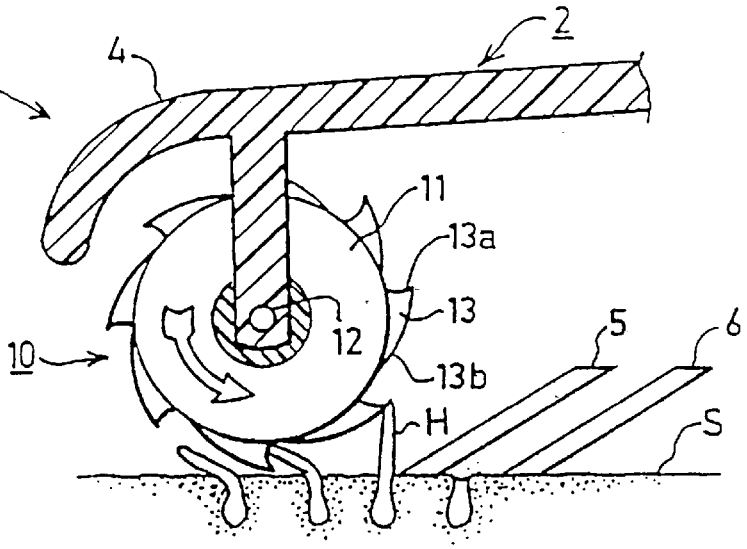
FIG. 2 is an enlarged fragmentary view illustrating the hair erecting assembly in the shaver of FIG. 1.

Referring now to the drawings, The shaving apparatus illustrated in FIGS. 1 and 2 is a manual shaver. It includes a shaver head 2 carried on a handle 3 which is graspable by the user for moving the shaver head across the user's skin (e.g., face) to be shaved of hair. Shaver head 2 includes a housing for carrying a pair of blades 5, 6, in spaced relation to each other and angled such as to cut the hairs as the shaver head is moved across the user's skin. Such shaver heads are commonly constructed in the form of replaceable cartridges detachable from the handle 3. Since such manual shavers are well known, further details of its construction are not set forth herein.

According to the present invention, the shaver head 2 is provided with a hair erecting device in the form of a rotary assembly, generally designated 10 forwardly of and adjacent to the leading razor blade 5 for moving the hairs towards an erect position prior to their engagement by that razor blade.

The rotary assembly 10 is more particularly illustrated in FIG. 2. It includes a cylindrical rotary member 11 rotatably mounted on an axis 12 supported by the shave." housing 4 just forwardly of the leading razor blade 5 and parallel to the axis of that razor blade, Cylindrical member 11 is formed on its outer surface with a plurality of protrusions configured to engage the hairs H and to move them towards an erect position during the rotation of cylinder 11 before such hairs are engaged by the leading razor blade 5

The protrusions 13 are in the form of fins extending lengthwise of the rotary cylinder 11, Each fin 13 has a first face 13*a* defining a large angle with a tangent of the surface of cylinder 11, and a second face 13*b* defining a smaller angle with the tangent of the surface of the cylinder. As shown particularly in FIG. 2. cylinder 11 is rotated such that face 13*a* of the fins 13 first engage the hairs H and move them towards an erect position, and face 13*b* of the fins then engage the hairs to maintain them in such an erect position before the hairs are engaged by the first leading razor blade 5. Such a construction thus better assures that the hairs will be neatly cut adjacent to their roots, thereby producing a close shave.

The leading razor blade 5 also gently stretches the skin S between it and the trailing razor blade 6. This stretching of the skin by the leading razor blade 5 causes hairs uncut by it, or the remnants of hairs cut by it, to move towards an erect position for cutting by the trailing razor blade 6.

It will thus be seen that in the hair razor device illustrated in FIG. 2, there is a combination of different actions for better assuring that the hairs will be cut close to their roots. Thus, the engagement of the fins 13 with the hairs 5 moves the hairs towards an erect position preparatory for cutting by the leading razor blade 5; and the stretching of the skin by the leading razor blade 5 also tends to move to an erect position any hairs uncut by it, or the remnants of hairs by it, preparatory to being cut by the trailing razor blade 6.

Preferably, the leading face 13*a* of each fin 13 is of a concave configuration, and the trailing face 13*b* of each fin is of a convex configuration. Also, each fin has a relatively thick base decreasing in thickness to its outer tip. Fins 13 may be conveniently formed integrally with cylinder 11 of any suitable material. Preferably, the material is of a flexible elastomeric material, such as natural or synthetic rubber.

Figure 3:
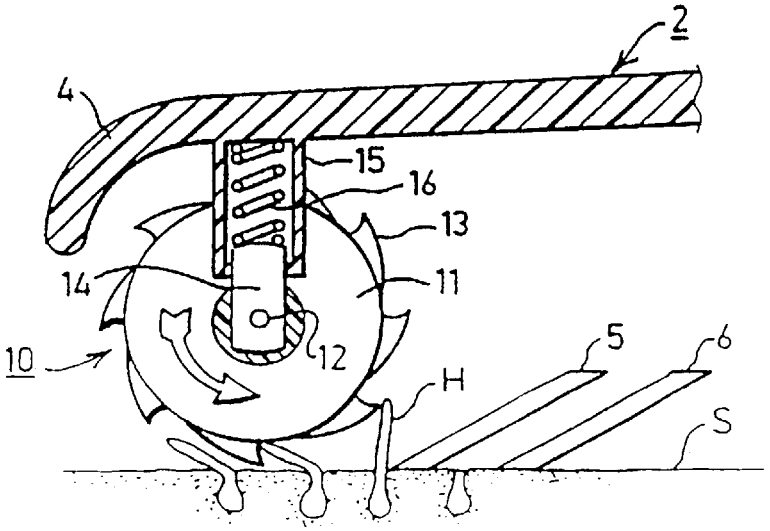
FIG. 3 is a view similar of that of FIG. 2 but illustrating a modification in the construction of the hair erecting assembly.

FIG. 3 illustrates a modification in the construction of the rotary hair erecting assembly 10 of FIG. 2. In this modification, the rotary cylinder 11 is floatingly mounted with respect to housing 4 of the shaver head 2. For this purpose, axis 12 of rotary cylinder 13 is carried by a pair of mounting pins 14 received within a pair of hollow stems 15 of shaver housing 4 and spring-urged to an outer position with respect to the stems by a spring 16. Thus, the floating construction illustrated in FIG. 3 enables the rotary cylinder 11, and particularly its hair erecting fins 13. to more closely follow the contour of the user's skin S when engaging and erecting the hairs H.

Figure 4:
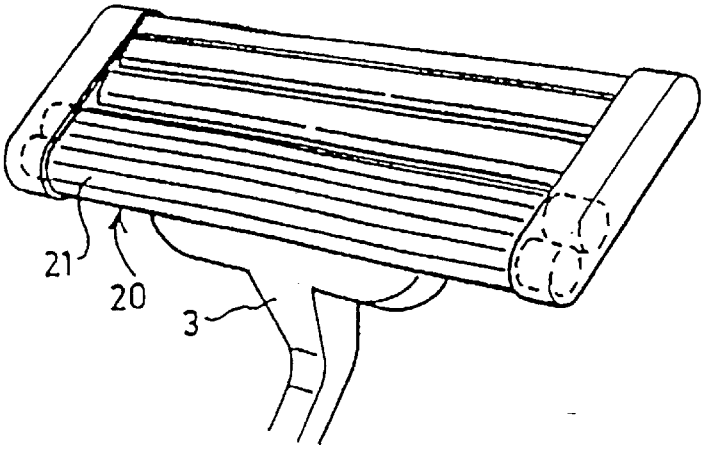
FIG. 4 illustrates another form of manual shaver constructed in accordance with the present invention.
Figure 5:
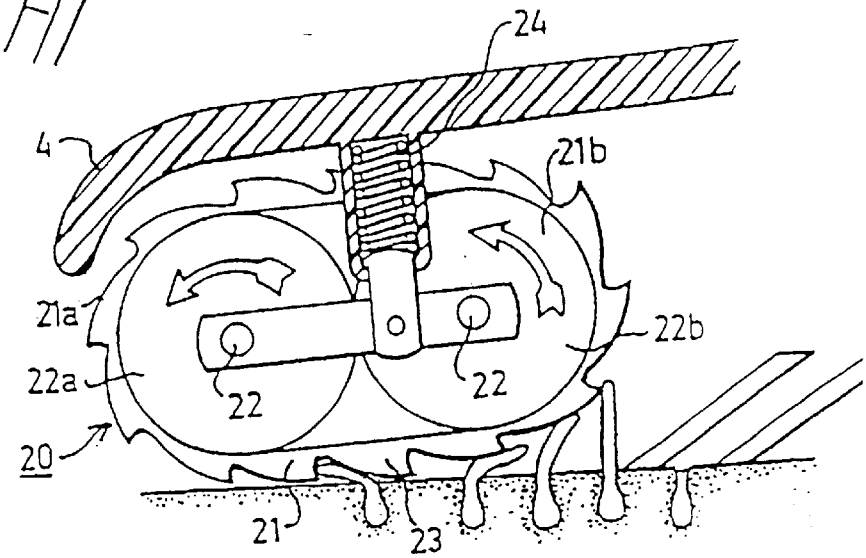
FIG. 5 is an enlarged fragmentary view illustrating the hair erecting assembly in the shaver of FIG. 4.

FIGS. 4 and 5 illustrate a further modification in the construction. In this case, the rotary hair erecting assembly, therein generally designated 20, includes a closed loop web 21 supported and rotated by a pair of rotary members 22*a*. 22*b*, at the opposite ends of the web. The web 21 is formed with the hair erecting protrusions or fins 23 which operate in substantially the same manner as described above with respect to FIGS. 1 and 2. In the construction of FIGS. 4 and 5, the rotary hair erecting assembly 20 is also floatingly mounted by the spring 24 so as to closely follow the contour of the user's skin.

Figure 6A:
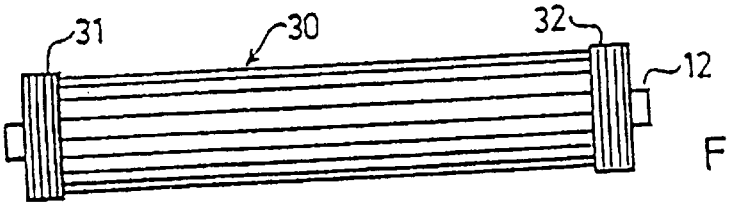
FIG. 6*a* is a side elevational view of the hair erecting assembly in the shaver of FIG. 6.
Figure 6:
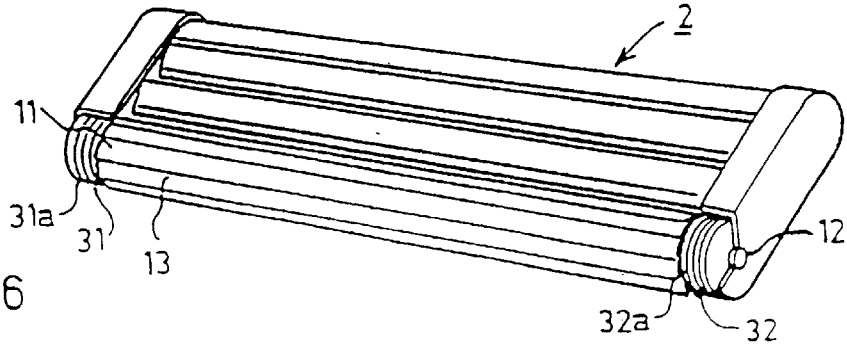
FIG. 6 illustrates a further form of manual shaver constructed in accordance with the present invention.

FIGS. 6 and 6*a* illustrate a construction similar to that of either of FIGS. 1, 2 or FIG. 3, namely one having a rotary hair erecting assembly, therein generally designated 30, including a rotatable cylinder 11 rotatably mounted about an axis 12 and formed with the protrusions or fins 13 which engage the hairs and move them towards the erect position by the rotation of cylinder 11 to prepare the hairs for severance by the razor blades. The rotary assembly 30 in FIGS. 6 and 6*a* is preferably floatingly mounted as shown in FIG. 3 by spring 16 (FIG. 3).

The rotary assembly 30 in FIGS. 6 and 6*a*, however, includes a pair of rollers 31, 32 at the opposite ends of the assembly mounted for rotation with cylinder 11 on shaft 12. The end rollers 31, 32 are of a diameter so as to engage the user's skin when the shaver head is moved along it to rotate cylinder 11 and its fins 13. The two end rollers 31, 32, however, are provided with a plurality of circumferentially-extending ribs, as shown at 31*a* and 32*a*, respectively, which are axially spaced from each other. These ribs engage the skin of the user such as to restrain movement of the cutter head in the axial direction, i.e., parallel to axis 12, and thereby constrain movement of the shaver head to a direction perpendicular to the axis 12 of the rollers, and the axis of the razor blades 5, 6, carried by the shaver head, This arrangement thus reduces the danger of cutting or nicking the user's skin while shaving.

Figure 7:
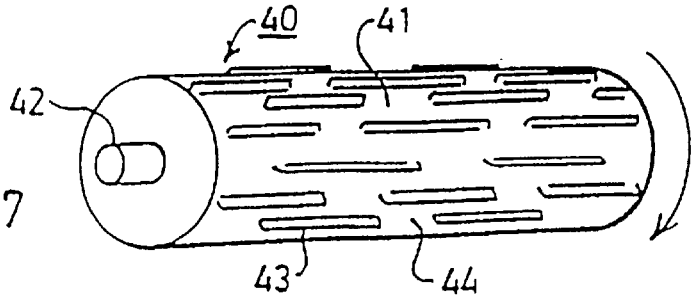
FIG. 7 illustrates another form of hair erecting assembly in accordance with the present invention.

FIG. 7 illustrates a modification in the rotary hair erecting assembly, therein generally designated 40, also including a cylinder 41 rotatable about an axis 42 and formed with a plurality of longitudinally-extending protrusions or fins 43. In the construction in FIG. 7, however, the fins 43 are not continuous, but rather are formed with interruptions 44, with the interruptions being in staggered relationship from one fin to the other, such that any hairs skipped by one fin will be engaged by the next.

Figure 8:
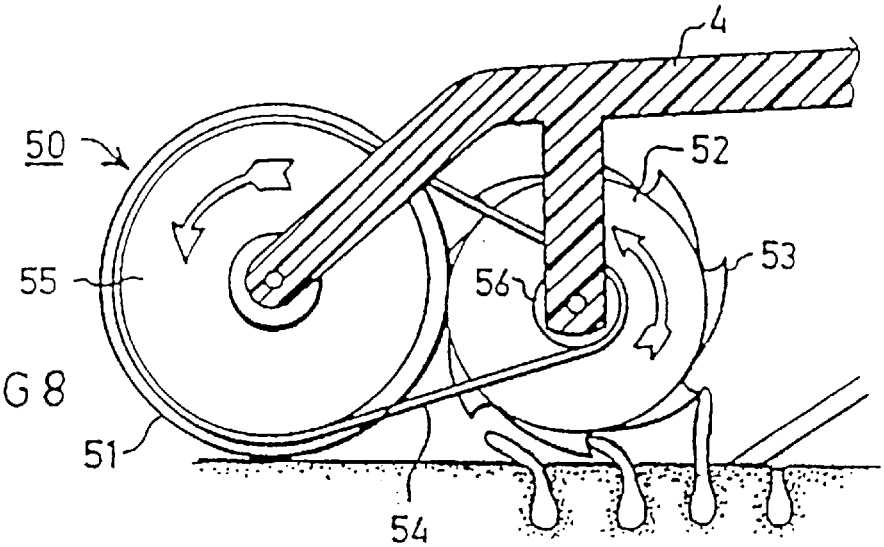
FIGS. 8 and 9 are fragmentary views illustrating two further forms of the hair erecting assemblies in accordance with the present invention.

FIG. 8 illustrates another construction, wherein the rotary hair erecting assembly, therein generally designated 50, includes a first cylinder or roller 51 which is rollable along the user's skin, and a second cylinder 52 which is formed with the hair erecting protrusions or fins 53. Cylinder 52 is coupled to cylinder 51 by means of a step-up transmission which rotates roller 52 at a larger rotary velocity than that of cylinder 51. Thus, the fins 53 formed in cylinder 52 will rotate at a larger angular velocity than cylinder 51 to engage the hairs, move them towards the erect position, and retain them in such position preparatory to being cut by the razor blades.

In FIG. 8, the step-up transmission is shown as including a pulley belt 54 coupled between a large pulley 55 on cylinder 51, and a smaller pulley 56 on cylinder 52.

Figure 9:
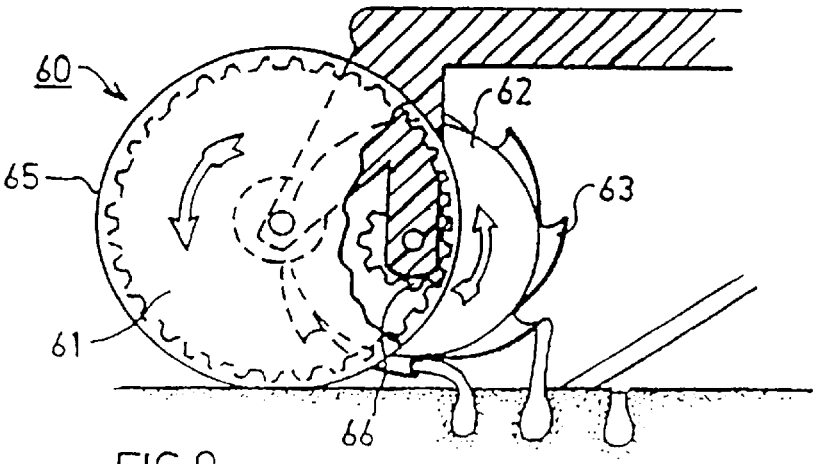

FIG. 9 illustrates a similar arrangement including a step-up gear transmission. Thus, the rotary hair erecting assembly in FIG. 9, therein designated 60, also comprises a first cylinder 61 rotatable along the user's skin, and a second cylinder 62 formed with the hair erecting protrusions or fins 63 which are rotated by the rotation of cylinder 61. In this case, the gear step-up transmission includes a large ring gear 65 fixed to cylinder 61, and a smaller gear 66 fixed to cylinder 62, such that the rotation of cylinder 61, when moved along the user's skin, also rotates cylinder 62 but at a higher rotary velocity.

Figure 10:
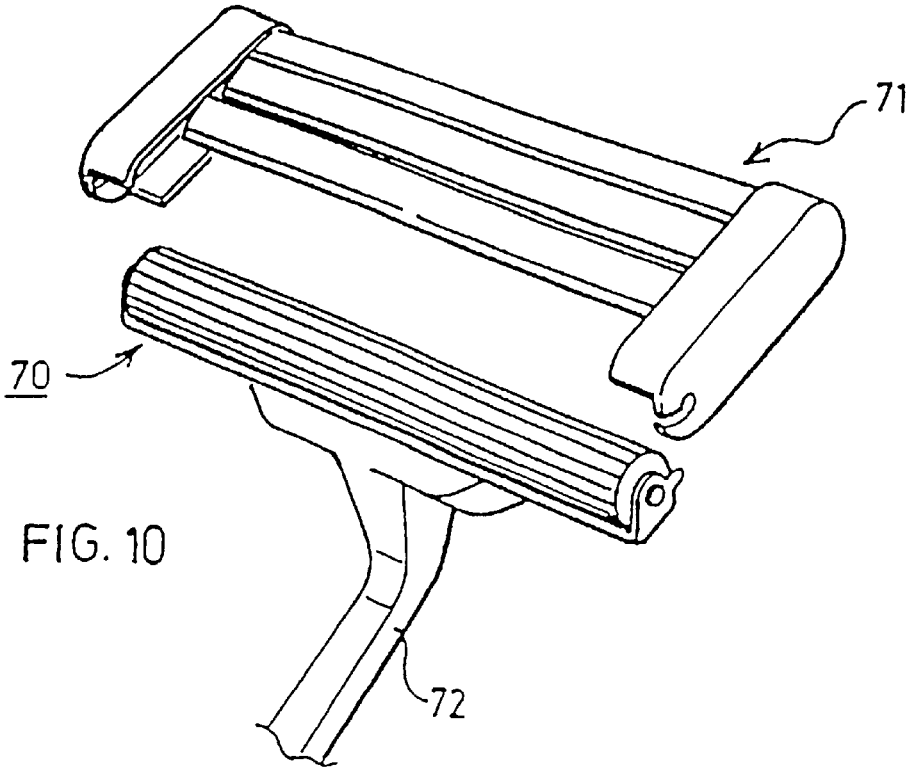
FIG. 10 illustrates a further manual shaver construction in accordance with the present invention.

In all the above-described constructions, the rotary hair erecting assembly is shown as incorporated into the cartridge containing the razor blades 5, 6, so that it is also automatically replaced when introducing a new cartridge containing new razor blades. FIG. 10 illustrates a modification wherein the rotary hair erecting assembly, generally designated 70, is not incorporated into the same cartridge 71 as the razor blades, but rather is incorporated in the handle 72, Thus, in the arrangement illustrated in FIG. 10, only the razor blades are replaced with each cartridge change, and the rotary hair erector assembly 70 is retained permanently with the handle 72, The cartridge may be removably attached to the handle in any suitable manner, e.g., by bayonet slot 73 formed at the end of the cartridge receivable within the opposite ends of shaft 74 of the rotary assembly 70.

Figure 11:
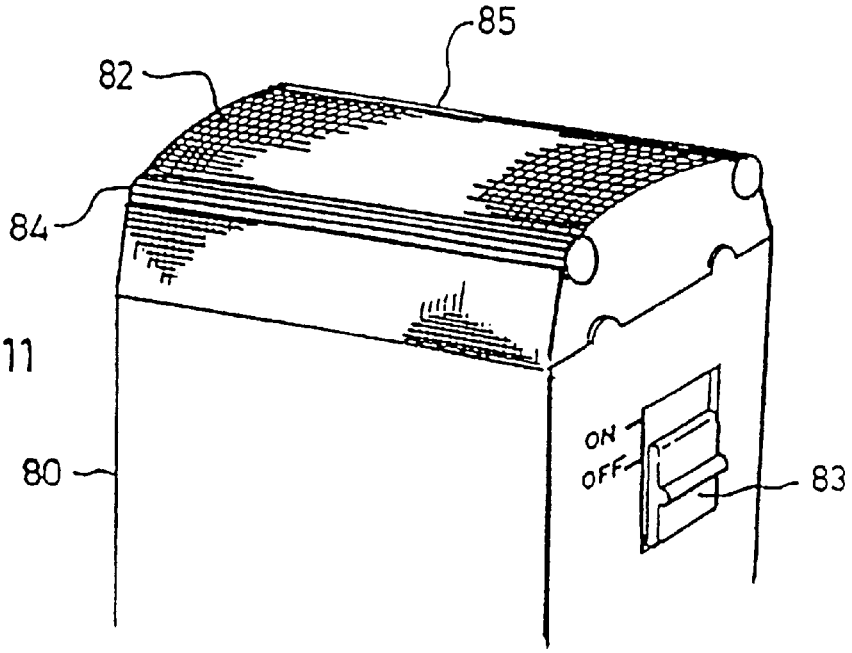
FIG. 11 illustrates an electrical shaver constructed in accordance with the present invention.

FIG. 11 illustrates the invention as embodied in an electric shaver 80, wherein the cutter device includes blades 82 driven by an electric motor (not shown) under the control of an electrical switch 83. In the construction illustrated in FIG. 11, two rotary hair erecting assemblies are provided, 84 and 85, respectively, on opposite sides of the blades 82 so as to be effective in either direction of movement of the electric razor over the skin of the user. The rotary assemblies 84, 85 may be rotated by rolling contact along the user's skin, or alternatively, by the motor within the electric razor 80 so as to have a rotary velocity larger than produced by rolling the assembly along the user's skin.

Figure 12:
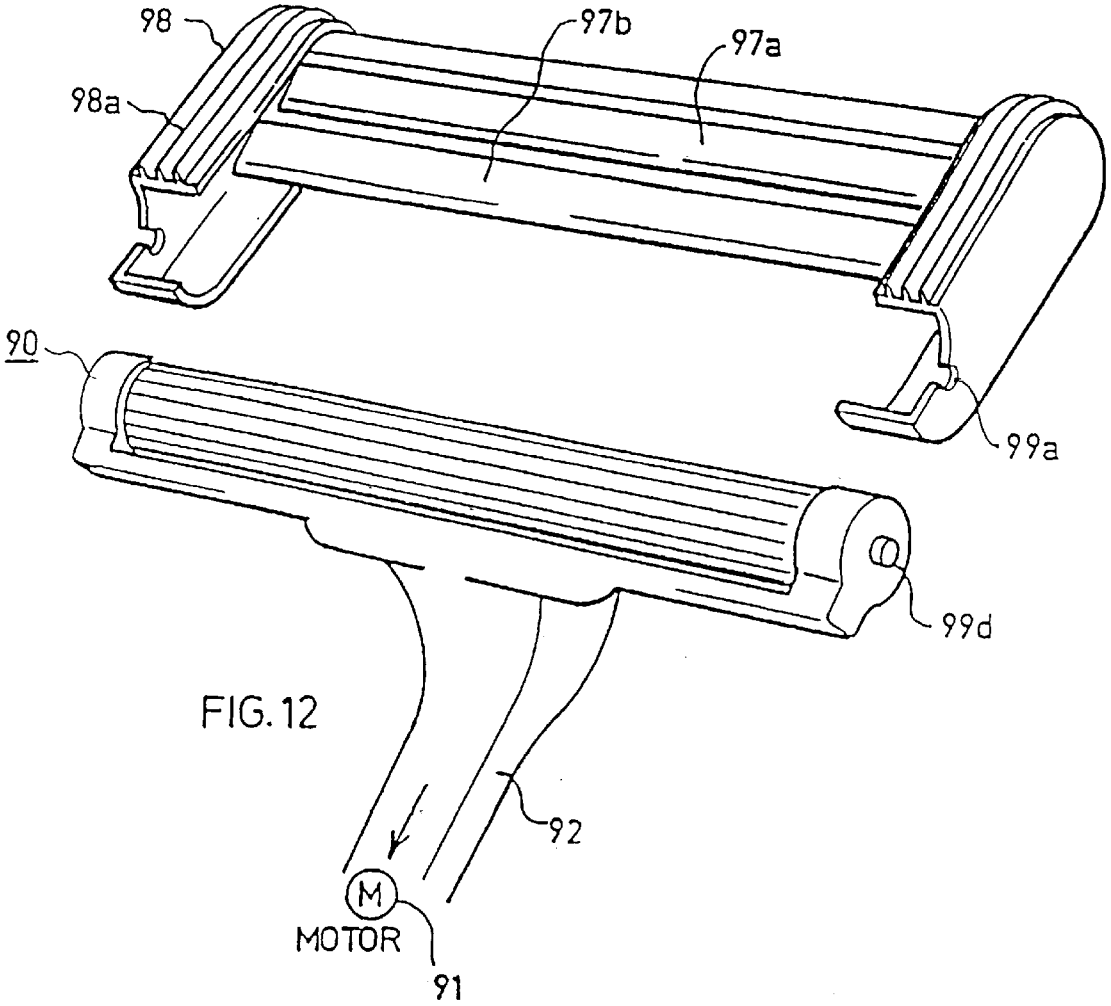
FIG. 12 is an exploded view illustrating another shaver in accordance with the invention.
Figure 13:
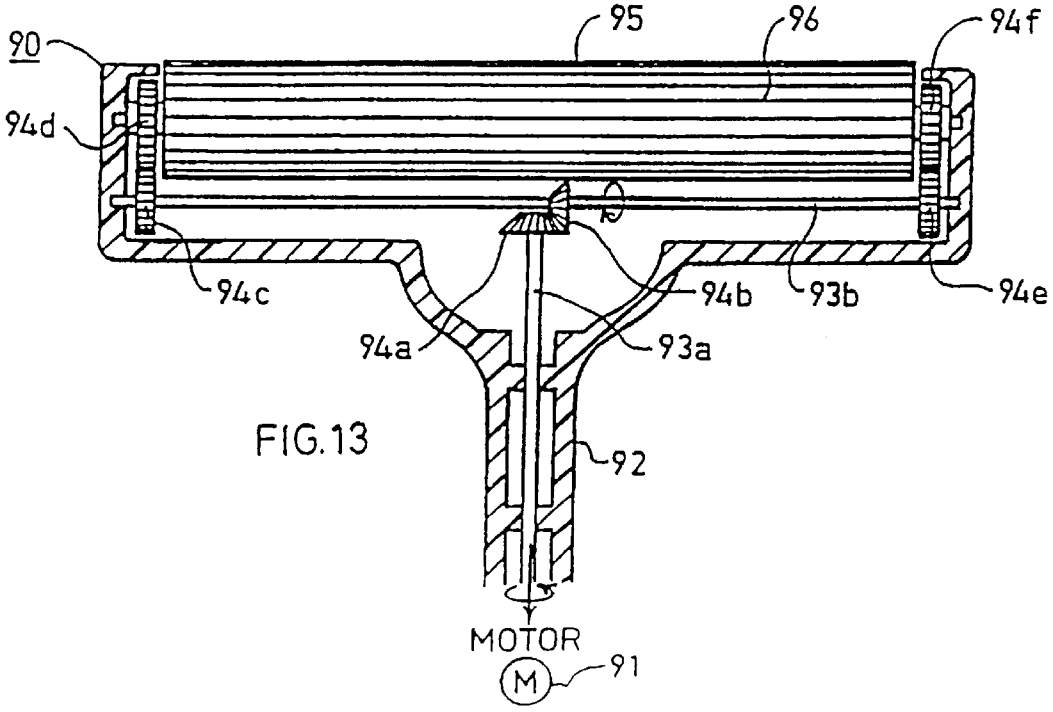
FIG. 13 is a sectional view of the shaver of FIG. 12.
Figure 14:
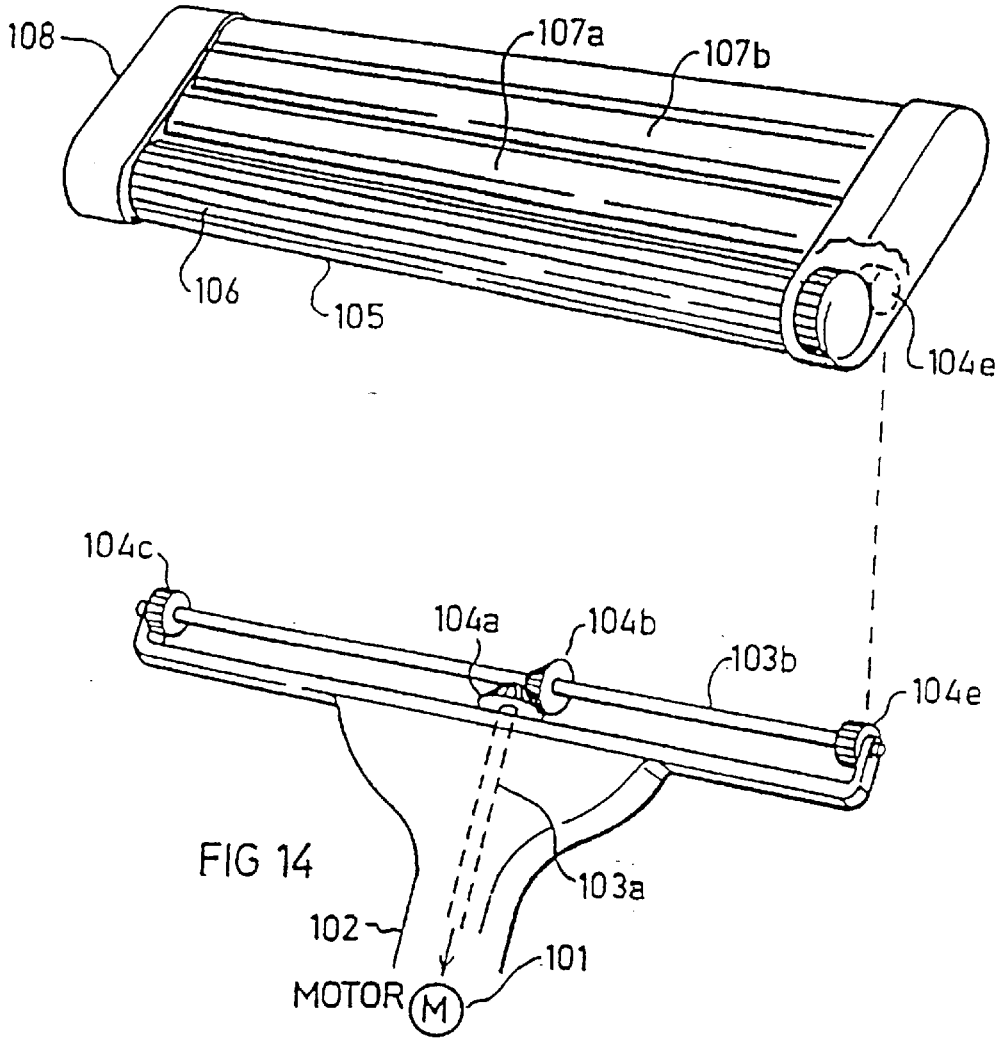
FIG. 14 is an exploded view illustrating a further shaver in accordance with the invention.

FIGS. 12 and 13 illustrate a construction similar to that of FIG. 10, except the rotary hair erecting assembly, generally designated 90, is rotated by an electrical motor, shown schematically at 91 in FIG. 130 located in the handle 92 of the shaver and coupled to the assembly 90 by shafts 93*a*. 93*b*. and gears 94*a*–94*e*, which rotate the cylinder 95 containing the hair-erecting fins 96. 'the two razor blades 97*a*, 97*b* are contained within a cartridge 98 which is removably attachable to the rotary hair erecting assembly 90 by means of bayonet slots 99*a*, formed at the opposite ends of the cartridge, receivable within the opposite ends of shaft 99*b* of the rotary assembly 90. The opposite ends of cartridge 98 are formed with ribs 98*a* extending perpendicularly to the axis of the blade 97*a*., 97*b*, of the cartridge. Ribs 98*a* serve a similar function as ribs 31*a*, 32*a* in rollers 31, 32 of the FIG. 6 construction, in that they tend to constrain the movement of the shaver head to the direction perpendicular to blades 97*a*, 97*b*, to reduce the danger of nicking the user's skin, FIG. 14 illustrates a similar construction as that of FIGS. 12, 13, also including a motor 101 located within the handle 102 of the manual shaver and coupled by shafts 103*a*. 103*b* and gears 104*a*–104*e* to the rotary cylinder 105 formed with the hair erecting fins 134. In the construction of FIG. 14, however, the motor 101, its shafts 103*a*, 103*b*, and gears 104*a*–104*e* are all contained within the shaver handle 102; whereas the rotary cylinder 105 containing the hair erecting fins 134 is included within the replaceable cartridge 136 containing the razor blades 107*a*, 107*b* so that it will also be replaced with the replacement of the razor blades.

Figure 15:
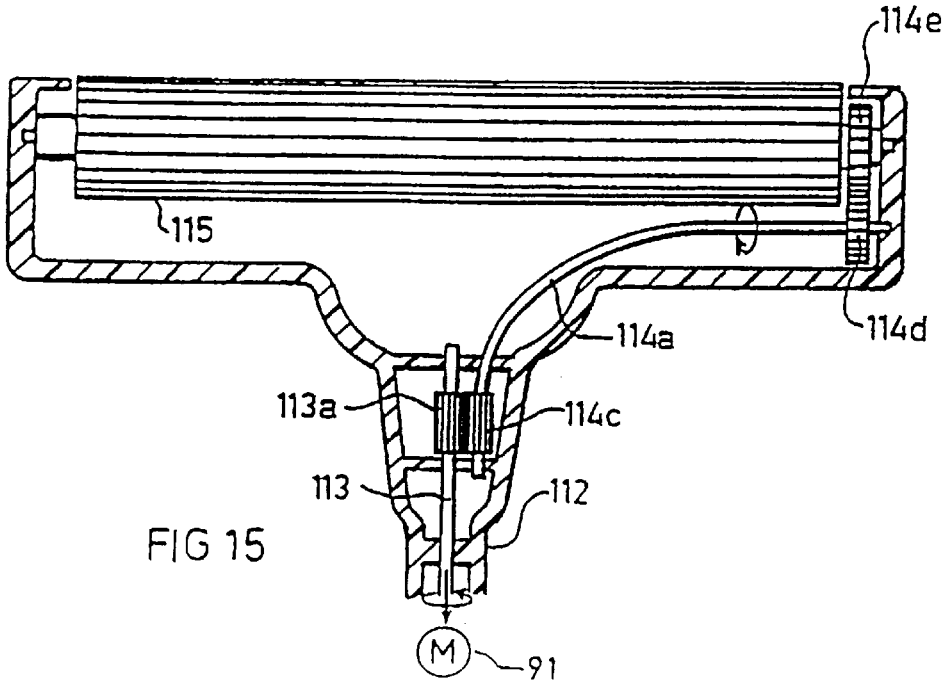
FIG. 15 is a sectional view illustrating a still further shaver in accordance with the invention.

FIG. 15 also illustrates a construction similar to that of FIGS. 12. 13, including a motor (not shown) incorporated within, the handle 138 of a manual shaver for rotating the rotary hair-erecting cylinder 115. In this case, however, the transmission between the electric motor and the cylinder includes a first shaft 113 for rotating a first gear 113*a*, and a further shaft 114*a*, coupled to gear 113*a* to rotate cylinder 115, by gears 114*c*–114*e*. In the construction illustrated in FIG. 15, the rotary hair erecting cylinder 115 may be part of the handle, as shown for example in FIGS. 12, 13, or a part of the replaceable blade cartridge as shown in FIG. 14, so as to be replaced therewith.

Figure 16:
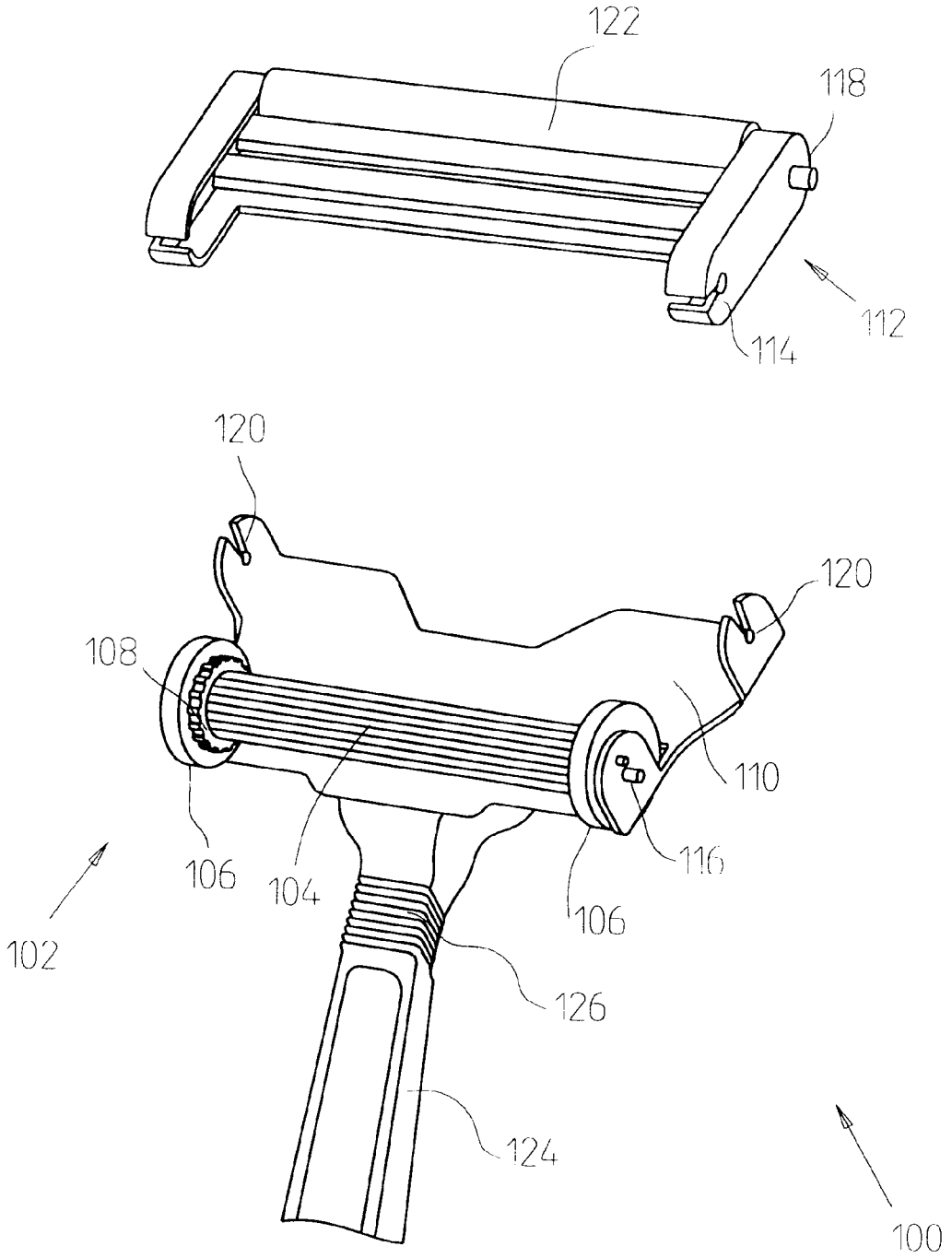
FIG. 16 is a dissembled view of a further shaving apparatus in accordance with the invention in which a mechanical hair erecting device forms part of a handle unit adapted for receiving replaceable blade cartridges.

Turning now to FIG. 16, there is shown a shaving apparatus 100, constructed and operative according to the teachings of the present invention. Shaving apparatus 100 is generally similar to the embodiment of FIG. 10 described above, but includes a number of additional features which will now be described.

Firstly, apparatus 100 features a mechanical drive mechanism 102 for rotating the rotary assembly 104. Drive mechanism 102 may be any type of mechanism, but is exemplified here as employing a pair of drive wheels 106 configured to engage the surface of the user's skin so as to rotate as the shaving apparatus is drawn across the skin. Each drive wheel has an internally toothed track 108 for supplying rotational power to rotary assembly 104. This mechanism is equivalent to that described with reference to FIG. 9 above.

Apparatus 100 also features a support plate 110 which provides improved support for the blade cartridge 112. Attachment of cartridge 112 may, by way of example, be achieved by providing slots 114 for receiving pins 116 projecting from the sides of the handle head. Additional pins 118 projecting from cartridge 112 engage sockets 120 at the extremities of support plate 110.

Cartridge 112 preferably features a rear roller 122. Rear roller 122 preferably has a surface configured for dispensing a chemical preparation onto the skin of the user. The chemical preparation is generally chosen either to assist in the shaving process itself or to soothe the skin of the user immediately after passing of the blades. Suitable chemical preparations include, but are not limited to, lubricants and moisturizers. The design of the surface constructions for rear roller 122 may be similar to that used for conventional fixed lubricant strips used in certain commercially available razors. Additionally, the surface may be designed with a wide range of characteristics including, but limited to, sponge-like, perforated and flexible surfaces.

In certain implementations, a mechanical coupling (not shown) may be provided between rear roller 122 and the drive mechanism of the hair erecting device. In one possible example, rear roller 122 is driven by the drive mechanism such that it turns against the surface of the user's skin. This enhances delivery of the chemical preparation onto the skin. In an alternative implementation, drive wheels 106 are omitted and rear roller 122 provides the rotational power to the drive mechanism.

Preferably, the handle 124 of shaving apparatus 100 features a hinge 126 for permitting tilting of support plate 110, and hence of cartridge 112, relative to the handle. Hinge 126 may be most simply implemented as a flexible section integral to the handle.

It should be noted that the attachment of the rotary assembly and/or drive mechanism to the handle need not be direct as shown, but may be achieved through a floating mounting similar to that described with reference to FIG. 3 above.

Figure 17:
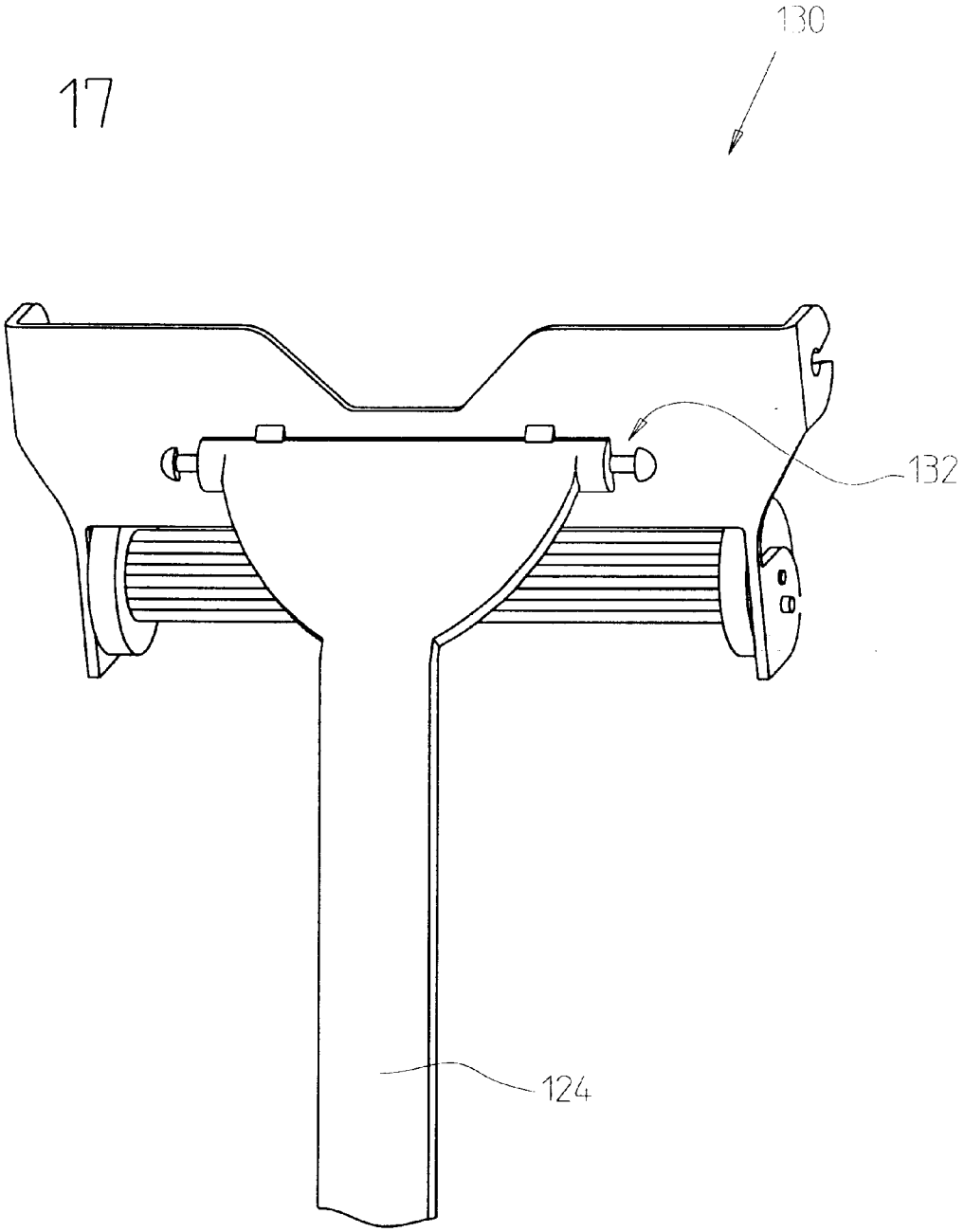
FIG. 17 is a rear view illustrating a variant of the embodiment of FIG. 16.

Turning now to FIG. 17, this shows a shaving apparatus 130 generally similar to shaving apparatus 100. In this case, hinge 126 is replaced by a pivotal connection 132 between handle 124 and the hair erecting device unit.

Figure 18:
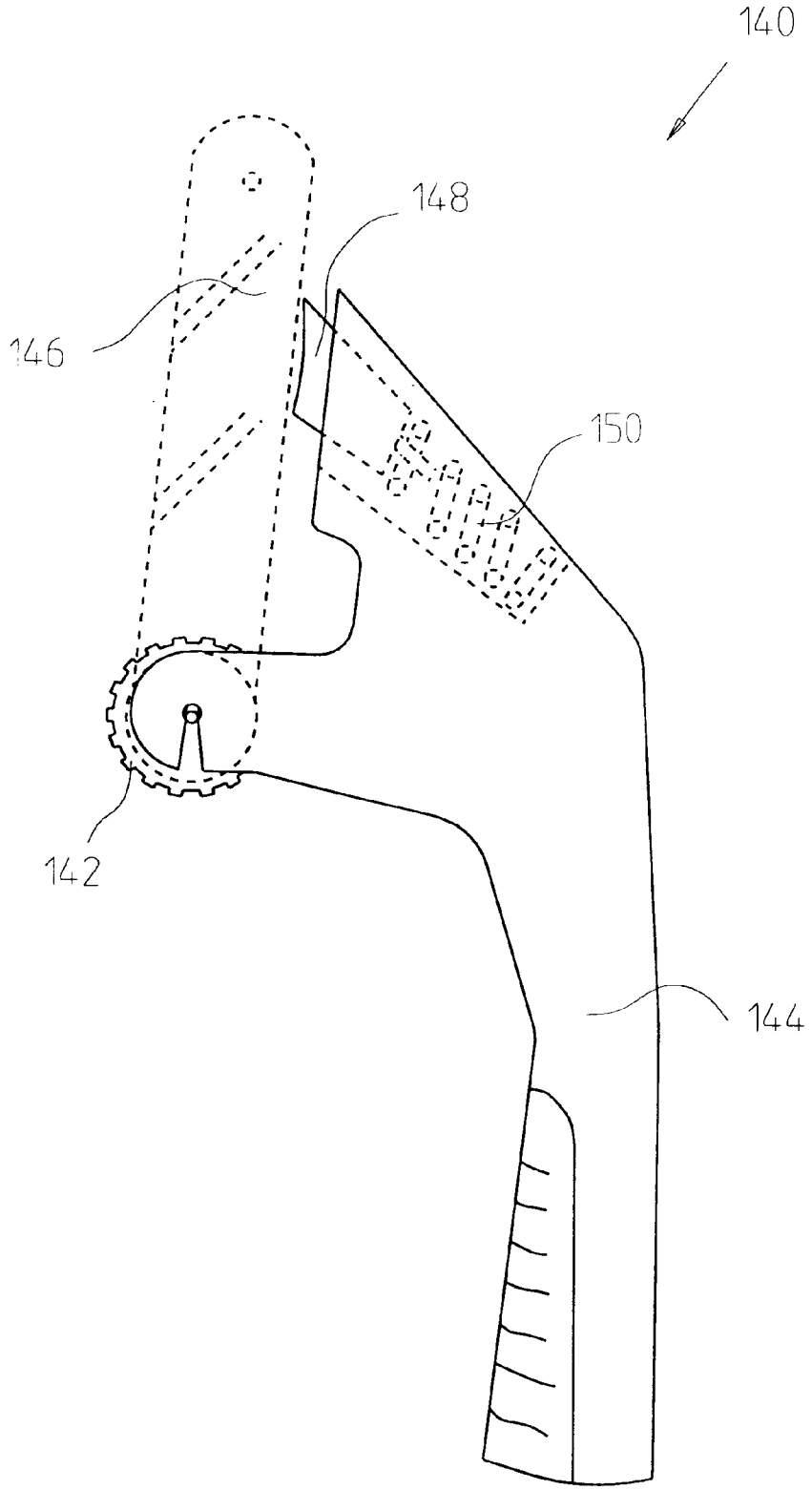
FIG. 18 is a side view of yet a further shaving apparatus in accordance with the present invention.

Finally, turning to FIG. 18, there is shown a further embodiment of a shaving apparatus 140, constructed and operative according to the teachings of the present invention. Shaving apparatus 140 is also generally similar to the embodiment of FIG. 10, including a rotary assembly 142 attached to a handle 144 and a blade cartridge 146 pivotally mountable about the axis of the rotary assembly. Handle 144 includes a support 148 for supporting a part of the replaceable cartridge displaced from the axis. In a basic implementation, support 148 may be a fixed, non-flexible element. In a preferred implementation, support 148 includes a spring element 150 which serves to bias cartridge 146 to a given angular position relative to handle 144.

Spring element 150 may be any type of spring element capable of biasing the cartridge to the correct position and allowing some range of angular rotation. Suitable examples include, but are not limited to, helical or leaf springs made from metal and resilient rubber or plastic elements.

Support 148 is typically attachable to the rear of cartridge 146 so as to delimit a range of angular movement of the cartridge. Alternatively, the pivotal connection of cartridge 146 about the axis of rotary assembly 142 may be configured to limit forward tilting of the cartridge. In the latter case, support 148 may simply abut the rear surface of the cartridge.

While the invention has been described with respect to several preferred embodiments, it will be appreciated that these are set forth merely for purposes of example, and that many variations may be made. For example, the outer surface of the rotary assembly could be formed with discrete protrusions, e.g., parallel lines of hemispherical projections, etc. Many other variations, modifications and applications of the invention may be made.

It will be appreciated that the above descriptions are intended only to serve as examples, and that many other embodiments are possible within the spirit and the scope of the present invention.

What is claimed is:

1. A shaving apparatus to be drawn by a user across an area of skin in a shaving direction for removing hair from the area of skin, the apparatus comprising:

(a) a handle to be held by the user;

(b) a cutter device mountable on said handle, said cutter device including at least one blade extending transversely to the shaving direction; and (c) a hair erecting device mounted forwardly of and adjacent to said cutter device, said hair erecting device including:

(i) a rotary assembly mounted so as to be rotatable about an axis parallel to said cutter device, said rotary assembly having a plurality of projections for engaging the hair of the user, said projections extending parallel to said axis, and (ii) a drive mechanism for driving said rotary assembly such that said projections engage the hair of the user and erect the hair so as to improve operation of said cutter device.

2. The shaving apparatus of claim 1, wherein said hair erecting device is attached to said handle and said cutter device is implemented as a replaceable cartridge, said replaceable cartridge being pivotally mountable about the axis of the rotary assembly, said handle including a support for supporting a part of said replaceable cartridge displaced from said axis.

3. The shaving apparatus of claim 2, wherein said support includes a spring element.

4. The shaving apparatus of claim 1, wherein said hair erecting device is attached to said handle to form a handle unit, said cutter device being implemented as a replaceable cartridge mountable on said handle unit, wherein said handle unit includes a hinge for permitting tilting of said cutter device relative to said handle.

5. The shaving apparatus of claim 4, wherein said hinge is implemented as a flexible section integral to said handle.

6. The shaving apparatus of claim 4, wherein said hinge is implemented as a pivotal connection between said handle and said hair erecting device.

7. The shaving apparatus of claim 1, further comprising a rear roller mounted behind said cutter device, said rear roller having a surface configured for dispensing a chemical composition onto the skin of the user.

8. The shaving apparatus of claim 1, further comprising a rear roller mounted behind said cutter device, said rear roller being coupled so as to be driven by said drive mechanism.

9. The shaving apparatus of claim 1, further comprising a rear roller mounted behind said cutter device, said rear roller being coupled so as to provide rotational power to said drive mechanism.

10. The shaving apparatus of claim 1, wherein said drive mechanism includes at least one drive wheel configured to engage the surface of the user's skin so as to rotate as the shaving apparatus is drawn across the skin, said drive wheel having an internally toothed track for supplying rotational power to said rotary assembly.

11. A shaving apparatus to be drawn by a user across an area of skin in a shaving direction for removing hair from the area of skin, the apparatus comprising:

(a) a handle to be held by the user;

(b) a cutter device mountable on said handle, said cutter device including at least one blade extending transversely to the shaving direction; and (c) a hair erecting device mounted forwardly of and adjacent to said cutter device, said hair erecting device including:

(i) a rotary assembly mounted so as to be rotatable about an axis parallel to said cutter device, said rotary assembly having a plurality of projections for engaging the hair of the user, and (ii) a drive mechanism for driving said rotary assembly such that said projections engage the hair of the user and erect the hair so as to improve operation of said cutter device, wherein said hair erecting device is rigidly attached to said handle and said cutter device is implemented as a replaceable cartridge, said replaceable cartridge being pivotally mountable about the axis of the rotary assembly, said handle including a support for supporting a part of said replaceable cartridge displaced from said axis.

12. The shaving apparatus of claim 11, wherein said support includes a spring element.

13. The shaving apparatus of claim 11, further comprising a rear roller mounted behind said cutter device, said rear roller having a surface configured for dispensing a chemical composition onto the skin of the user.

14. The shaving apparatus of claim 11, further comprising a rear roller mounted behind said cutter device, said rear roller being coupled so as to be driven by said drive mechanism.

15. The shaving apparatus of claim 11, further comprising a rear roller mounted behind said cutter device, said rear roller being coupled so as to provide rotational power to said drive mechanism.

16. The shaving apparatus of claim 11, wherein said drive mechanism includes at least one drive wheel configured to engage the surface of the user's skin so as to rotate as the shaving apparatus is drawn across the skin, said drive wheel having an internally toothed track for supplying rotational power to said rotary assembly.

17. A shaving apparatus to be drawn by a user across an area of skin in a shaving direction for removing hair from the area of skin, the apparatus comprising:

(a) a handle to be held by the user;

(b) a cutter device mountable on said handle, said cutter device including at least one blade extending transversely to the shaving direction; and (c) a hair erecting device mounted forwardly of and adjacent to said cutter device, said hair erecting device including:

(i) a rotary assembly mounted so as to be rotatable about an axis parallel to said cutter device, said rotary assembly having a plurality of projections for engaging the hair of the user, and (ii) a drive mechanism including at least one drive wheel configured to engage the surface of the user's skin so as to rotate as the shaving apparatus is drawn across the skin, said drive wheel having an internally toothed track for supplying rotational power to drive said rotary assembly such that said projections engage the hair of the user and erect the hair so as to improve operation of said cutter device.

18. Shaving apparatus, comprising:

(a) a shaver head carried at one end of a handle graspable by a user for moving the shaver head across the user's skin to be shaved of hair;

(b) a cutter device carried by said shaver head and extending transversely to the direction of movement of the shaver head across the user's skin; and (c) a hair erecting device forwardly of and adjacent to the cutter device for moving the hairs towards an erect position prior to their engagement with said cutter device;

said hair erecting device comprising a rotary assembly rotatably mounted to said handle about a rotary axis and having an outer surface formed with protrusions configured to engage the hairs and to move them towards an erect position during the rotation of the rotary assembly;

said cutter device including a razor blade assembly contained within a replaceable cartridge attached to said handle and to said rotary assembly of the hair erecting device rotatably mounted to said handle; said rotatable assembly of the hair erecting device being rotatably mounted on a shaft to said handle, and said replaceable cartridge containing the razor blade assembly being configured to receive opposite ends of said shaft.

* * * * *